US007644885B2

(12) United States Patent
Briante et al.

(10) Patent No.: US 7,644,885 B2
(45) Date of Patent: Jan. 12, 2010

(54) TOWEL ROLL HOLDER AND DISPENSER

(75) Inventors: Dominic Briante, Mount Sinai, NY (US); Mary P. Briante, Mount Sinai, NY (US)

(73) Assignee: Adams & Wilks, New York, NY (US)

( * ) Notice: Subject to any disclaimer, the term of this patent is extended or adjusted under 35 U.S.C. 154(b) by 172 days.

(21) Appl. No.: 11/824,876

(22) Filed: Jul. 2, 2007

(65) Prior Publication Data

US 2008/0290211 A1 Nov. 27, 2008

Related U.S. Application Data

(63) Continuation-in-part of application No. 11/288,738, filed on Nov. 29, 2005, now Pat. No. 7,370,825.

(51) Int. Cl.
*B65H 75/02* (2006.01)

(52) U.S. Cl. ..... 242/588.6

(58) Field of Classification Search ..... 242/588, 242/588.3, 588.6, 599.3, 599.4, 422.4; 206/395, 206/396, 397, 408; 53/456, 458
See application file for complete search history.

(56) References Cited

U.S. PATENT DOCUMENTS

| | | | | |
|---|---|---|---|---|
| 2,092,626 | A * | 9/1937 | Simon | 206/395 |
| 3,698,548 | A * | 10/1972 | Stenzel et al. | 242/588.4 |
| 6,817,162 | B1 * | 11/2004 | Gerulski et al. | 53/458 |
| 7,370,825 | B2 * | 5/2008 | Briante et al. | 242/588.6 |
| 2004/0016668 | A1 * | 1/2004 | Horn | 206/395 |

* cited by examiner

*Primary Examiner*—William A Rivera

(57) ABSTRACT

A towel roll holder and dispenser has a housing for receiving a towel roll therewithin. The housing has a pair of sidewalls, a base connected to the sidewalls for mounting the housing on a support surface, and a pair of cover members pivotable between a closed position and an open position. One of the cover members has an opening through which towels may be dispensed from the towel roll. The cover members are releasably fastened to the sidewalls of the housing.

14 Claims, 9 Drawing Sheets

TOWEL ROLL HOLDER AND DISPENSER

CROSS-REFERENCE TO RELATED APPLICATIONS

This application is a continuation-in-part of U.S. patent application Ser. No. 11/288,738 filed Nov. 29, 2005 now U.S. Pat. No. 7,370,825, which is herein incorporated by reference in its entirety.

BACKGROUND OF THE INVENTION

1. Field of the Invention

The present invention relates generally to devices for holding rolls of towels and, more specifically, to a device for supporting and enclosing a roll of continuous towel sheets such as paper towel sheets, and which facilitates dispensing of the sheets.

2. Background of the Invention

Rolls of towels, such as paper towels, have widespread use in both residential and commercial environments. Paper towels are typically dispensed from a roll of paper towels that is formed from a web of continuous paper towel sheets and are rolled about a tube. Several methods are known for dispensing such paper towels. In one method, the roll of paper towels is attached to a pair of brackets mounted underneath a cupboard or cabinet that includes spindles for engaging each end of the tube upon which the paper towels are rolled. When mounted in the horizontal orientation, the roll of paper towels is easily visible hanging from the cabinetry. Another method involves placing the paper towel roll over a vertical post mounted to a base and set on a countertop to stand vertically or mounted to a wall to extend outward horizontally. In either of these methods, the roll of paper towels is easily visible and can present an unsightly and cluttered appearance.

Moreover, another problem with the conventional paper towel dispensers is that they are not able to prevent the paper towels from becoming dirty due to, for example, handling of the roll of paper towels prior to or during dispensing of the paper towel sheets. This results in the paper towels being subjected to unclean and unsanitary conditions.

Many conventional paper towel holders and dispensers have been proposed which attempt to solve the foregoing problems in the conventional art. However, such paper towel holders and dispensers have a complex construction and are expensive to manufacture.

SUMMARY OF THE INVENTION

It is an object of the present invention to provide a highly decorative and functional device for holding and dispensing towel sheets from a roll of continuous sheets of towels.

It is another object of the present invention to provide a towel roll holder and dispenser which prevents towels from the roll from becoming dirty by keeping the towels in a clean and sanitary condition prior to being dispensed from the towel roll holder and dispenser.

A further object of the present invention is to provide a towel roll holder and dispenser that is simple and easy to use.

A still further object of the present invention is to provide a towel roll holder and dispenser that is easy and economical to manufacture.

The foregoing and other objects of the present invention are carried out, in one aspect, by a towel roll holder and dispenser comprising a main body having a bottom, a top, a rear wall, and a pair of opposing end walls defining an interior space for receiving a roll of towels for dispensing. A cover structure is pivotally attached to the main body for closing off the interior space of the main body when in a closed position. The cover structure has first and second cover members pivotable between the closed position and an open position and releasably held in the closed position. The first and second cover members and the main body together define an enclosure fully enclosing the roll of towels when the first and second cover members are in the closed position. The second cover member has a dispensing opening, such as an elongated aperture, through which a towel from the roll of towels can be dispensed from the enclosure when the first cover member is in the closed position.

The roll of towels is rotatively retained within the interior space of the main body between the pair of end walls so that a free portion of a towel from the roll of towels can extend through the elongated aperture of the second cover member. Preferably, the first cover member has a tearing mechanism that tears off the free portion of the towel during a dispensing operation. An unspooling mechanism is integrally connected to the second cover member to prevent towels from the roll of towels from unspooling during a dispensing operation.

The first and second cover members are releasably held in the closed position by releasable fasteners, such as snap locks mounted on the first and second cover members and releasably connected to holes formed in the end walls of the main body. Preferably, the enclosure is a one-piece structure made from a single piece of material, such as injection molded plastic.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
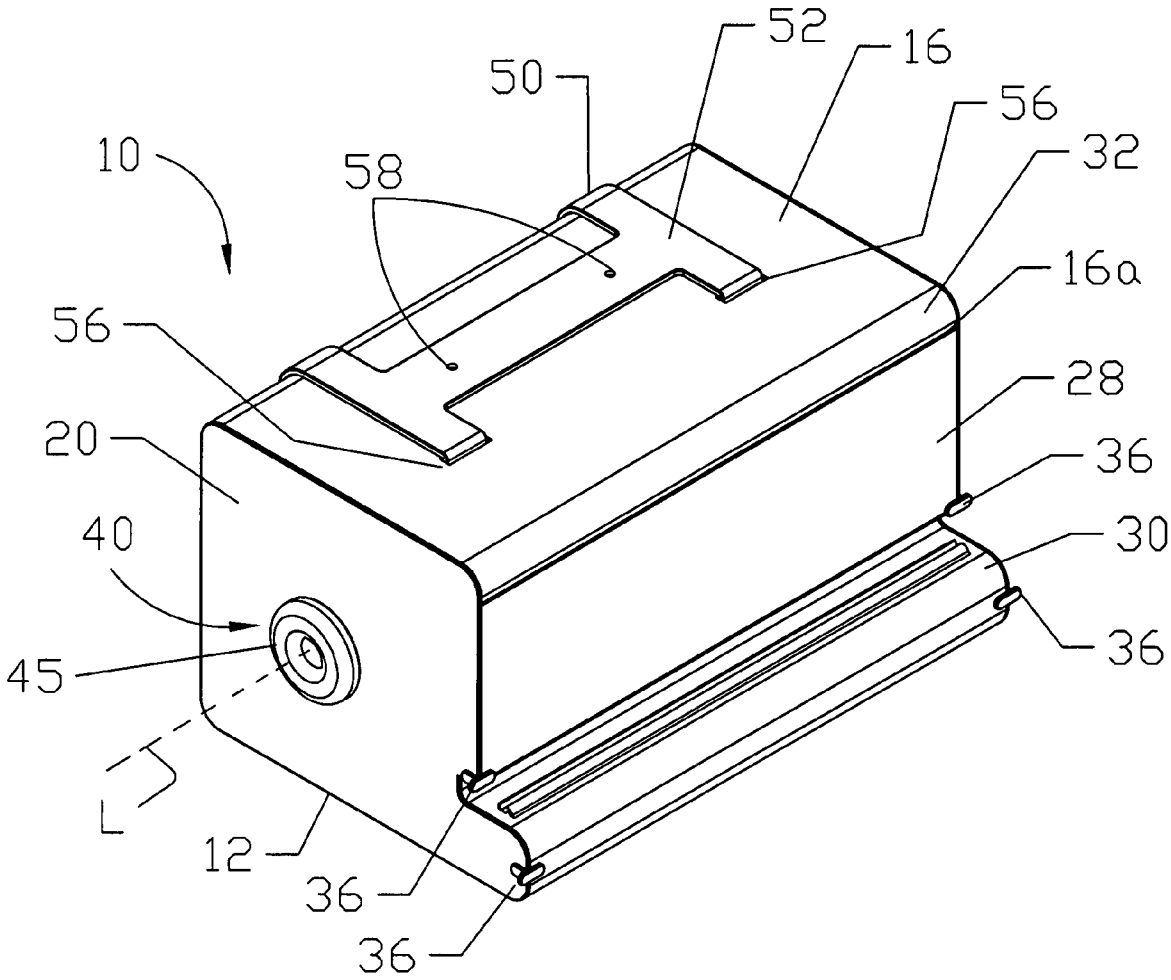
FIG. 1 is a front perspective view of a towel roll holder and dispenser according to an embodiment of the present invention.
Figure 2:
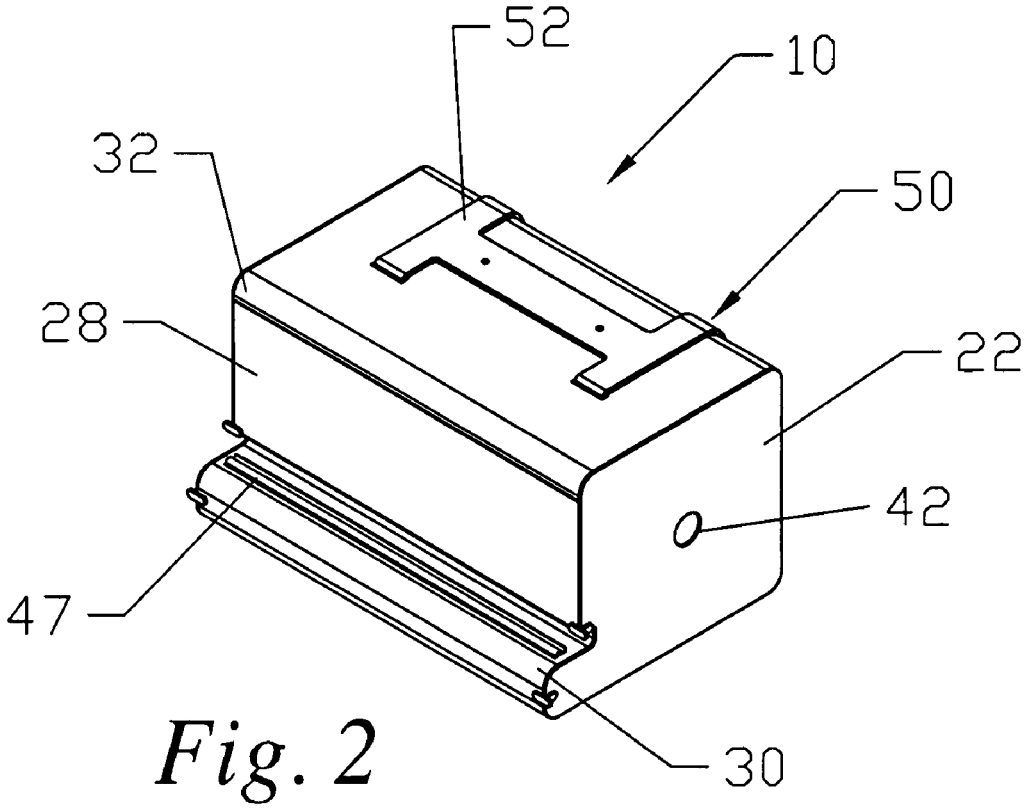
FIG. 2 is a right side perspective view of the towel roll holder and dispenser shown in FIG. 1.
Figure 3:
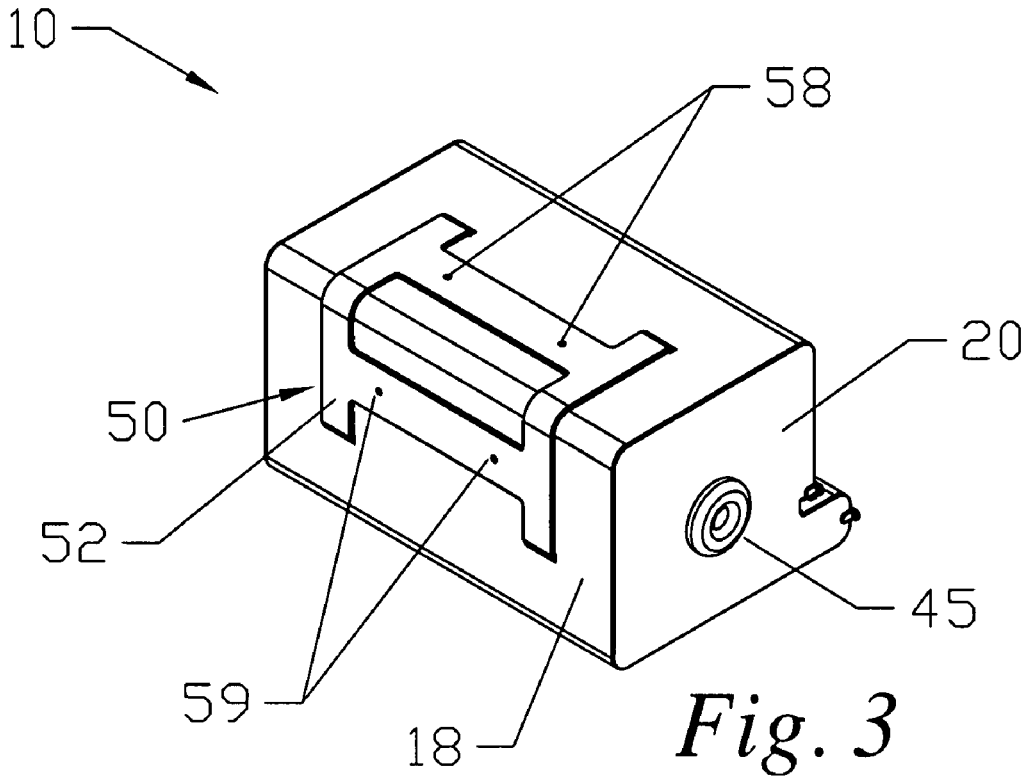
FIG. 3 is a rear perspective view of the towel roll holder and dispenser shown in FIG. 1.
Figure 4:
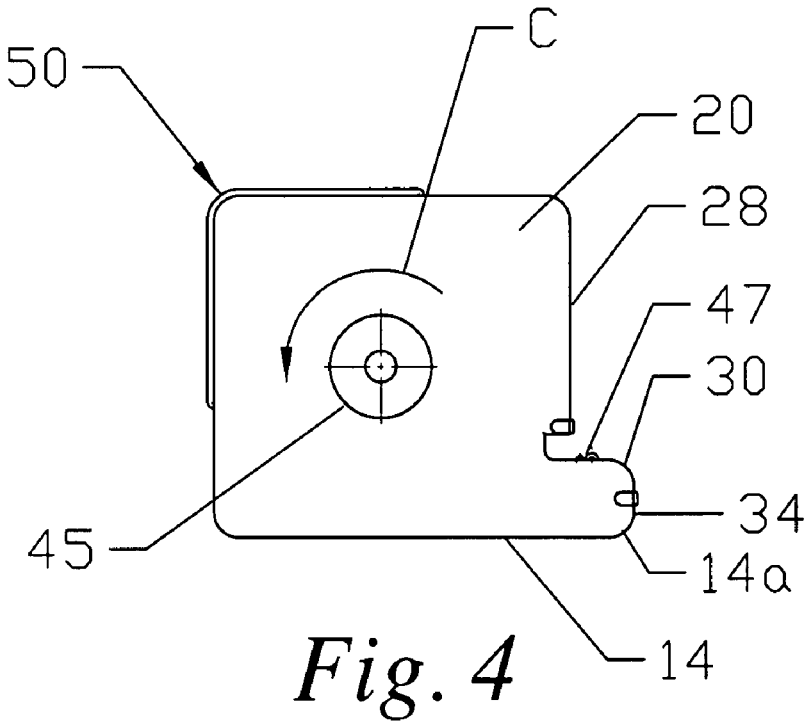
FIG. 4 is a left side view of the towel roll holder and dispenser shown in FIG. 1.

While this invention is susceptible of embodiments in many different forms, this specification and the accompanying drawings disclose only some forms as examples of the use of the invention. The invention is not intended to be limited to the embodiments so described, and the scope of the invention will be pointed out in the appended claims.

Certain terminology is used in the following description for convenience only and is not intended to be limiting. The words right, left, front, rear, upper, lower, bottom, top, horizontal and vertical designate directions in the drawing to which reference is made. Such terminology includes the words above specifically mentioned and words of similar import.

The preferred embodiment of the towel roll holder and dispenser is described below with a specific application to a roll of paper towels comprised of a plurality of severable sheets of paper wound together in a cylindrical roll. The individual sheets of paper are typically severed from the roll via transverse lines of perforations formed at predetermined intervals along the length of the roll. Such paper towel rolls are readily commercially available and known in the art. It should be noted, however, that the roll can be comprised of a plurality of other severable sheets such as toilet paper sheets or fabric softener sheets. Furthermore, it is understood that the sheets need not be limited to a material made of paper, but may also made of cloth or fabric. The present invention is also well adapted for dispensing wax paper, aluminum foil, plastic and the like for household or commercial use.

Referring now to the drawings in detail wherein like numerals have been used throughout the various figures to designate like elements, there is shown in FIGS. 1-10 embodiments of a towel roll holder and dispenser, generally designated at 10, according to the present invention. The towel roll holder and dispenser 10 includes a main body 12 that has a bottom 14, a top 16, a rear wall 18, a pair of opposing end walls 20, 22, and an open front end 24. The bottom 14, top 16, rear wall 18, and opposing end walls 20, 22 of the housing define an open space 26 for receiving and containing a roll of wound material, such as a roll of paper towels T.

Figure 5:
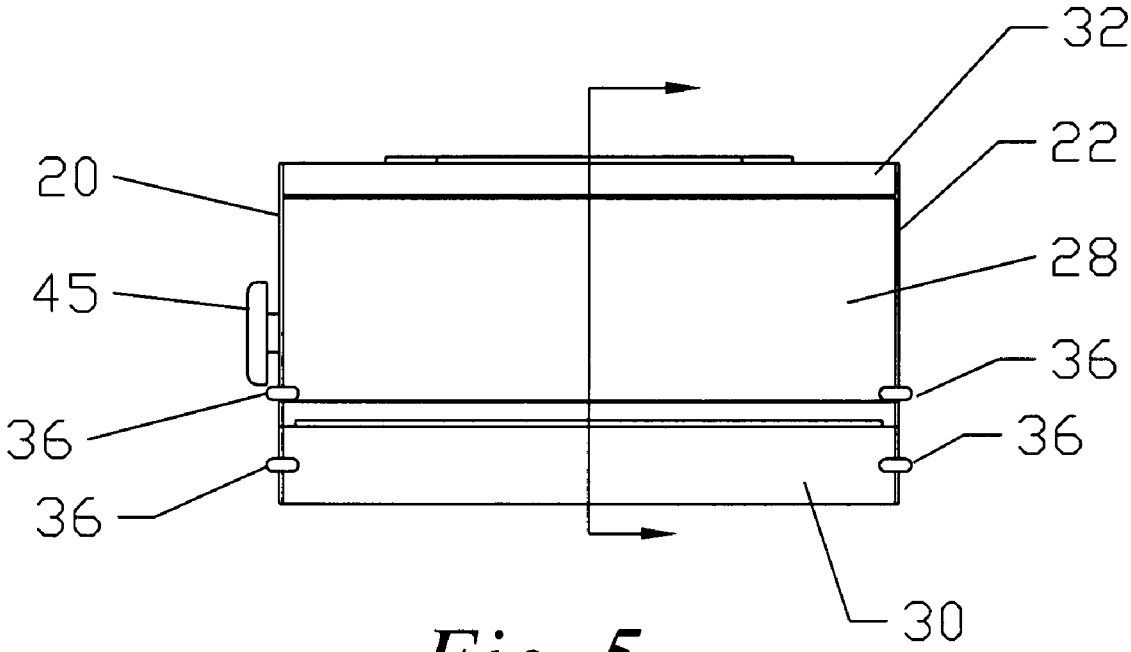
FIG. 5 is a front view of the towel roll holder and dispenser shown in FIG. 1.
Figure 10:
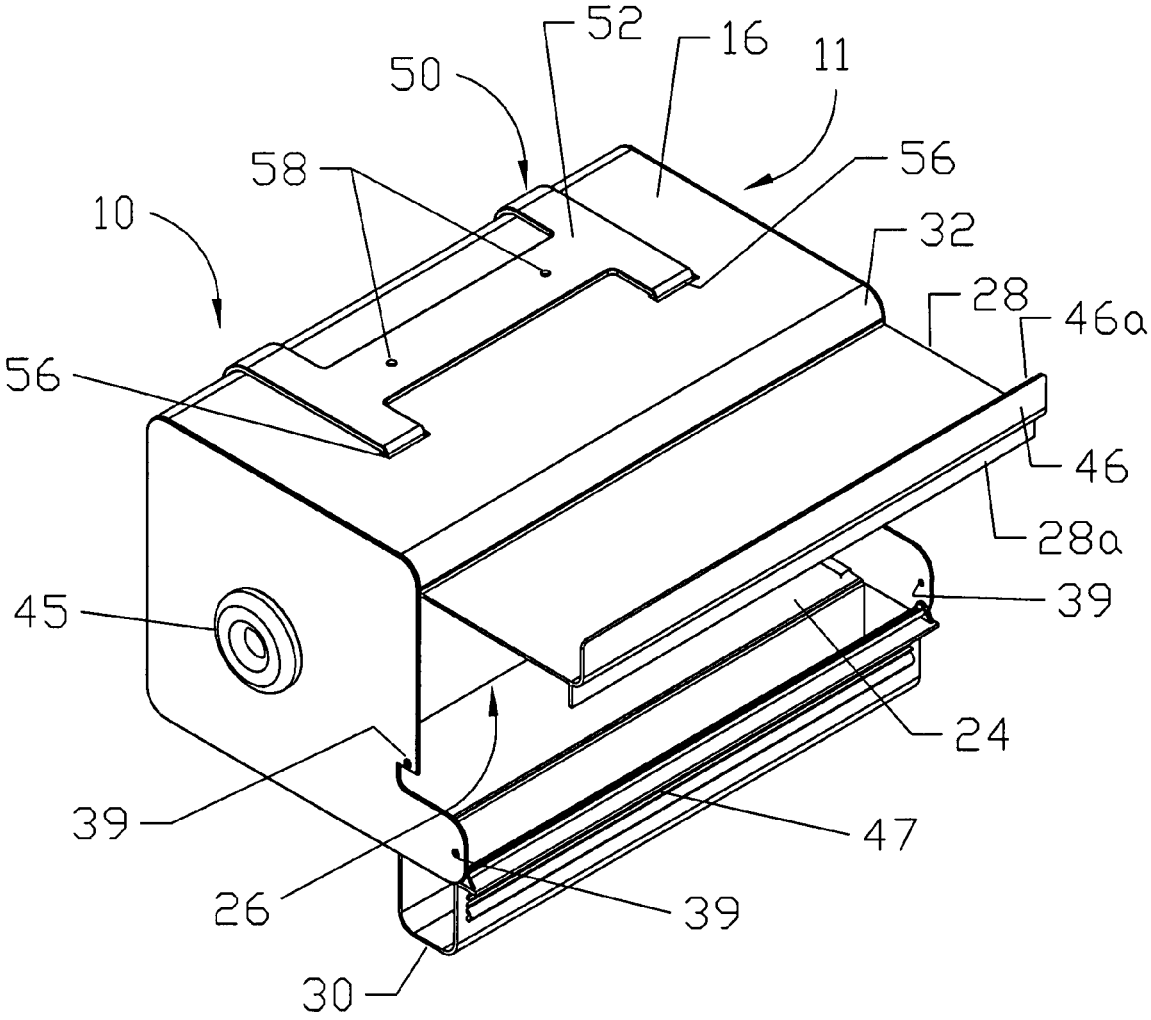
FIG. 10 is a front perspective view of the towel roll holder and dispenser shown in FIG. 1 with the cover members in the open position.

Referring to FIGS. 1, 5 and 10, the towel roll holder and dispenser 10 further includes a cover structure pivotally attached to the main body 12 for covering the open front end 24 of the main body 12 when the cover structure is in a closed position. The cover structure comprises first and second cover members 28, 30 pivotable in opposing directions between the closed position (as shown in FIG. 1) and an open position (as shown in FIG. 10). The first cover member 28 has a first longitudinal edge portion connected to a front edge portion 16*a* of the top 16 by means of a first hinge portion 32. An overturned portion 28*a* of the first cover member 28 extends from a second longitudinal edge portion opposite the first longitudinal edge portion thereof. The cover member 30 is connected to a front edge portion 14*a* of the bottom 14 by means of a second hinge portion 34 (FIGS. 6B, 7B). The first and second cover members 28, 30 and the main body 12 together define a container 11 fully enclosing the roll of towels T when the first and second cover members 28, 30 are in the closed position.

The towel roll holder and dispenser 10 further includes holding means for releasably holding each of the first and second cover members 28, 30 in the closed position as shown in FIG. 1. The holding means comprises fasteners 36 mounted on the first and second cover members 28, 30 for releasable connection to holes 39 formed on the end walls 20, 22. FIGS. 1-5 and 8 show the state in which the fasteners 36 are releasably connected to the holes 39, and in FIGS. 9-10 the fasteners 36 are in a released state. Illustration of the fasteners 36 has been omitted in FIG. 10 only for ease of understanding the open position of the towel roll holder and dispenser 10. Preferably, the fasteners 36 and holes 39 form snap locks. It is understood, however, that other forms of releasable fasteners are suitable for releasably holding the first and second cover members 28, 30 in the closed position. For example, the releasable fasteners may comprise VELCRO connectors or magnetic strips.

A retaining mechanism (retaining means) 40 rotatively retains the roll of paper towels T within the container 11 between the pair of end walls 20, 22 so that a free end portion T1 of the paper towel T can extend through the open front end 24 of the main body 12. The retaining mechanism 40 includes the end walls 20, 22 of the main body 12 having aligned apertures 42 therethrough. An elongated rod or roll post 44 extends through the container 11 and has a longitudinal axis in general alignment with the aligned apertures 42 to carry the roll of paper towels T. A knob 45 is connected to one end of the elongated rod 44 externally of the container 11 for rotating the elongated rod 44 in forward and reverse directions to thereby similarly rotate the roll of paper towels T.

The knob 45 is preferably connected to the end of the rod 44 with a friction fit which is sufficient to maintain connection between the end of the rod 44 and the knob 45 during a towel dispensing operation, but which is also capable of allowing a user to disconnect the knob 45 from the end portion of the rod 44 to permit removal of the rod 44 from the container 11, or at least withdrawal of the rod 44 in the longitudinal direction thereof, during replacement of a new roll or paper towels. Alternatively, the inner surface of the knob 45 and the outer surface of the end of the rod 44 may be formed with suitable threaded portions for removable threaded engagement therebetween. In yet another variation, the knob 45 and the end of the rod 44 can be connected together using manually adjustable set screws extending through through-holes formed in the knob 45 and contacting the outer surface of the end of the rod 44. The knob may be formed from a suitable plastic or metallic material.

Figure 6A:
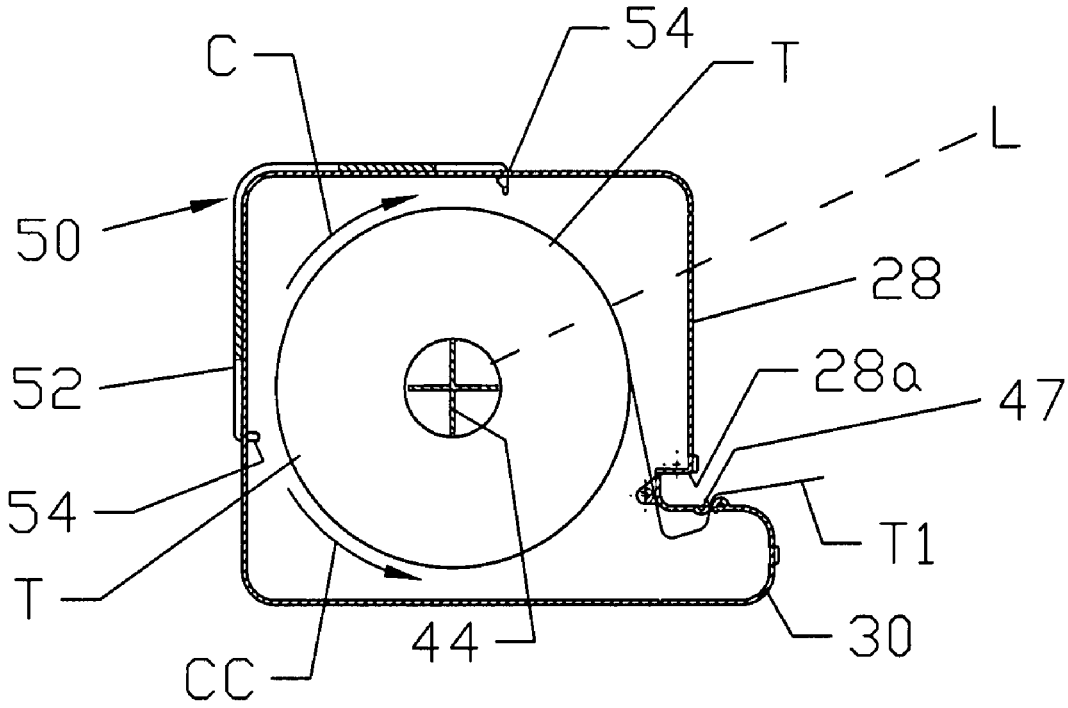
FIG. 6A is a cross-sectional view along line 6-6 shown in FIG. 5.
Figure 6B:
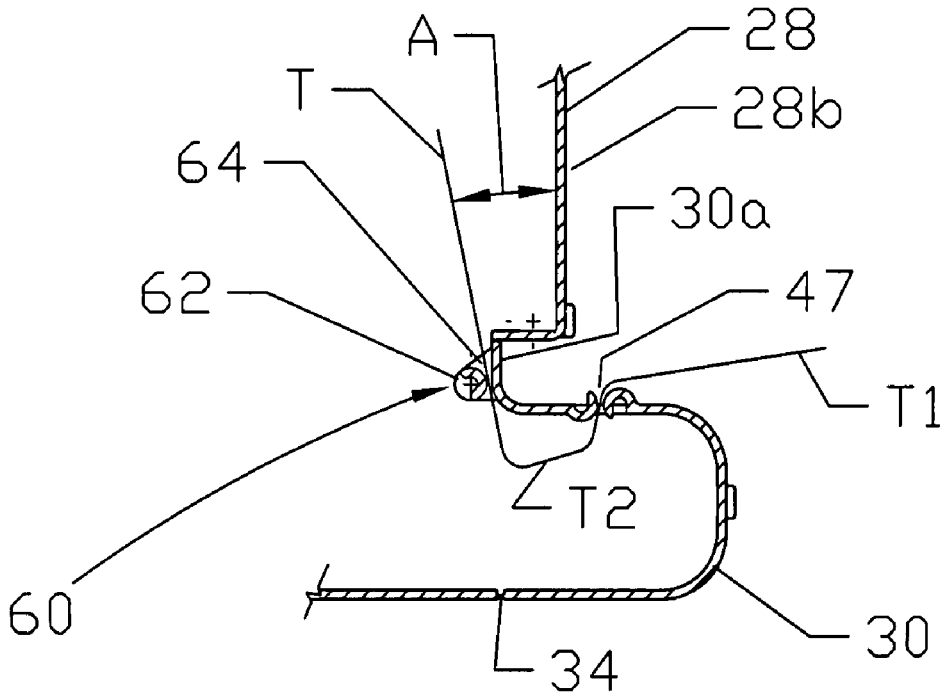
FIG. 6B is an exploded view of a portion of the towel roll holder and dispenser shown in FIG. 6A illustrating a towel sheet passing via the stop bar and through the contoured slot.

Referring to FIGS. 1, 6A and 6B, an elongated longitudinal slot 47 is formed in the second cover member 30 to facilitate dispensing of the paper towels T from the roll enclosed by the container 11. As best shown in FIG. 6B, the slot 47 is contoured (i.e., bounded by curved portions of the second cover member 30 forming the slot) in order to facilitate dispensing of paper towels from the container 11. The slot 47 is bounded in part by confronting longitudinal portions defining a portion of the perimeter of the slot 47 and which, in this embodiment, function as cutting edges for tearing the severable sheets of paper towels T from the roll of paper towels during a dispensing operation. For example, with reference to FIG. 6B, tearing of a sheet of paper towel T may be accomplished by pulling out the free end portion T1 of the paper towel from the slot 47 until the line of perforations on the sheet are positioned approximately adjacent to the perimeter (i.e., the longitudinal portions) of the slot 47. The user then tears the sheet along the perimeter of the slot 47 to separate the sheet from the roll.

In the embodiments shown in the drawings, the slot 47 extends generally parallel to a longitudinal axis L of the rod 44. However, in an alternative embodiment, and in order to facilitate separation or tearing apart of paper towels T from the roll, the slot 47 may be formed at an angle to the longitudinal axis L of the rod 44. The angle of the slot 47 may vary, and the orientation may vary from either direction away from the horizontal. In addition, the slot 47 may be either a straight line or curved. The angling of the slot 47 and the optional curving of the slot 47 are not only decorative, but functionally assist in tearing the paper towels T off the roll of paper towels. Stated otherwise, by angling the paper towels T away from the horizontal axis, the paper towels T may be more easily separated. In addition, this prevents the inadvertent pulling of more paper towels T from the inside of the container 11. For example, the slot 47 may angle in the range of 1 degree from the horizontal axis to plus or minus 45 degrees from the horizontal axis.

Moreover, in the embodiments shown in the drawings, the slot 47 is formed in a horizontal surface portion of the second cover member 30. It is understood, however, that the slot 47 may instead be formed in a vertical surface of the second cover member 30 without departing from the spirit and scope of the invention.

In an alternative embodiment, as shown in FIGS. 7A-7B and 8-10, a tearing mechanism 46 (tearing means) is disposed along the second longitudinal edge portion of the second cover member 30 and extends in a direction opposite to the direction of extension of the overturned portion 28*a* for tearing off the paper towel T from the roll. The tearing mechanism 46 preferably comprises a tearing lip formed integrally with the first cover member 28. The tearing lip has a cutting edge 46*a* for tearing the severable sheets of paper towels T from the roll of paper towels during a dispensing operation. For example, with reference to FIG. 7B, tearing of a sheet of paper towel T may be accomplished by pulling out the free end portion T1 of the paper towel T from the slot 47 until the line of perforations on the sheet are positioned approximately adjacent to the cutting edge 46*a*. The user then tears the sheet along the cutting edge 46*a* of the tearing lip to separate the sheet from the roll.

Figure 7A:
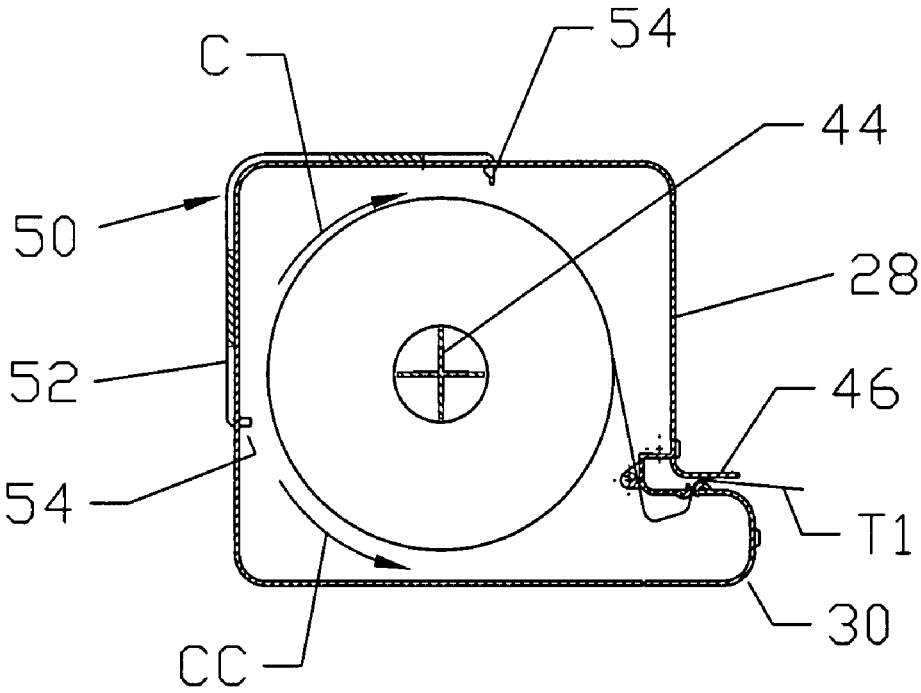
FIG. 7A is a cross-sectional view similar to FIG. 6A but directed to modified embodiment of the towel roll holder and dispenser.
Figure 7B:
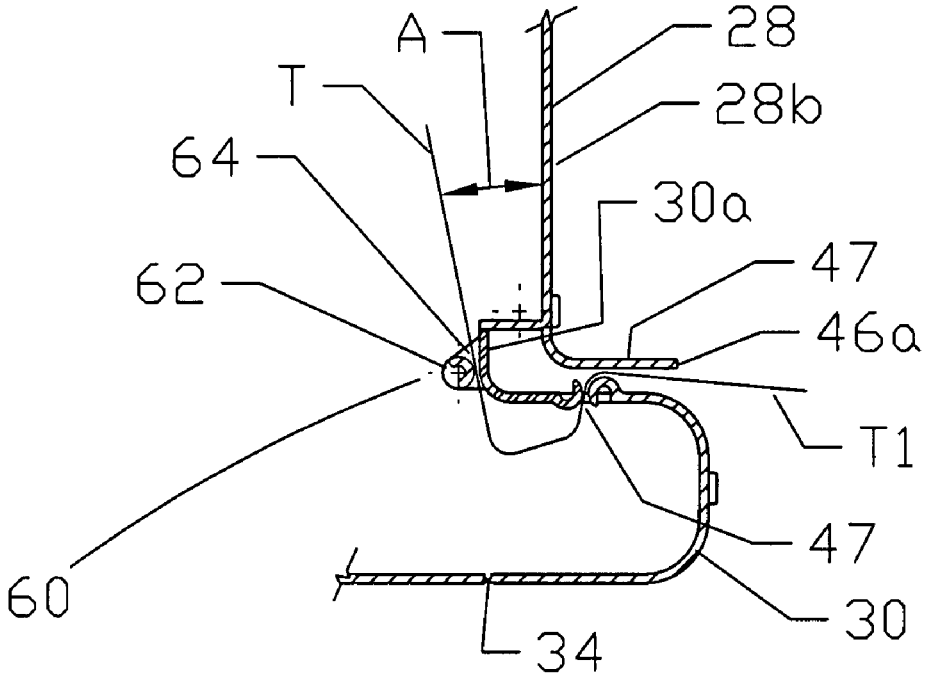
FIG. 7B is an exploded view of a portion of the towel roll holder and dispenser shown in FIG. 7A illustrating a towel sheet passing via the stop bar and through the contoured slot.
Figure 8:
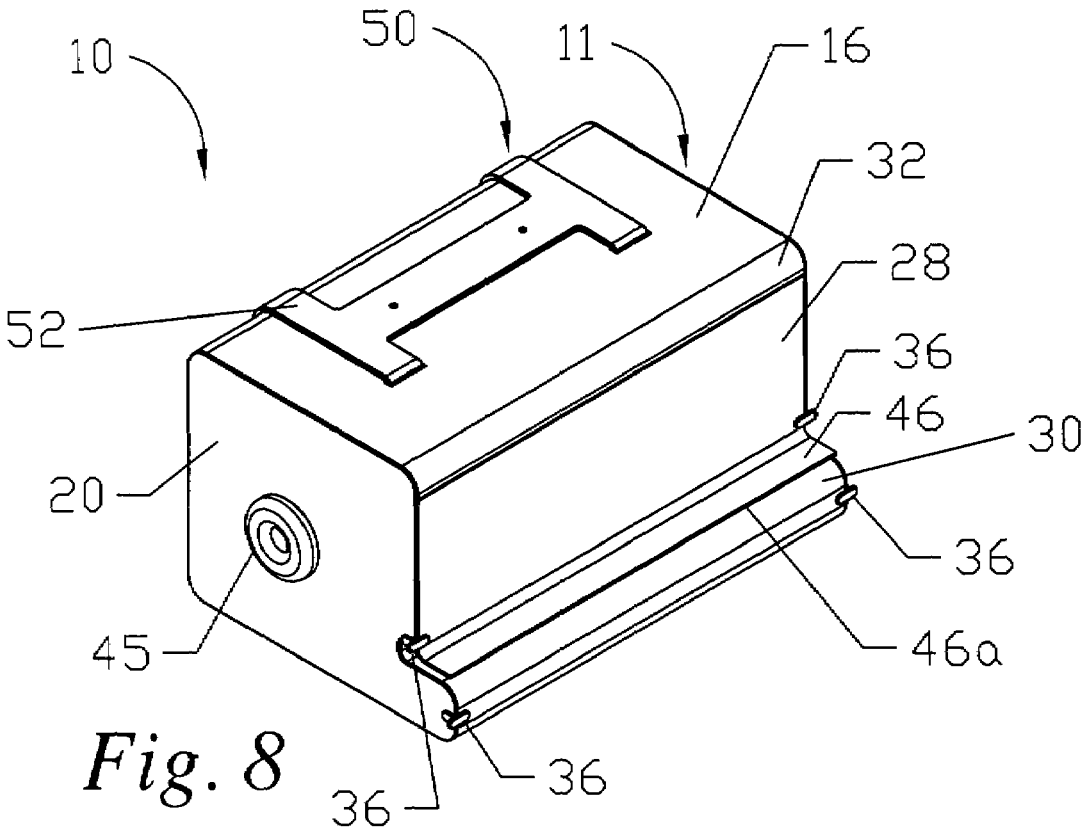
FIG. 8 is a front perspective view of the towel roll holder and dispenser shown in FIG. 7A.

In the foregoing embodiments, the towel roll and dispenser 10 includes an unspooling mechanism 60 (unspooling means) that prevents the roll of paper towel T from inadvertently unspooling from the roll as the paper towel is unwound from the roll. The unspooling mechanism 60 comprises a longitudinal bar 62 mounted on one side of a lip portion 30*a* of the second cover member 30 via support portions 64 to define a longitudinal space therebetween. The bar 62 extends along the length of the lip portion 30 which in the foregoing embodiments generally corresponds to the overall length of the container 11. The space between the bar 62 and the one side of the lip portion 30*a* of the second cover member 30 is dimensioned sufficiently to allow the sheet of paper towel T to be passed therethrough both initially during initial setup in preparation of the towel roll and dispenser 10 for dispensing operations and during the dispensing operations. Stated otherwise, the sheet of paper towel T extends between the support portions 64 and rides on the bar 62 during a dispensing operation. The unspooling mechanism 60 prevents the roll of paper towel T from inadvertently unspooling (i.e., rotate in a clockwise direction C as shown in FIGS. 6A, 7A) during a dispensing operation while allowing the sheets of paper towel T to pass through the space between the bar 62 and the one side of the lip portion 30*a* of the second cover member 30 during a dispensing operation. The space also permits the roll of paper towel T to rotate in a spooling direction (i.e., rotate in a counterclockwise direction CC as shown in FIGS. 6A, 7A) by manual rotation in the clockwise direction of the knob 45.

With reference to the embodiments shown in FIGS. 6B and 7B and in FIG. 10 showing the first and second cover members 28, in the open position, during a setup operation the roll of paper towel T is inserted into the open space 26 of the container 11 via the front end 24 and is mounted on the rod 44. The free end portion T1 of the first sheet of paper towel T from the roll is then passed through the space between the bar 62 and the one side of the lip portion 30*a* of the second cover member 30. The free end portion T1 of the sheet of paper towel T is then passed through the slot 47. After the first and second cover members 28, 30 are closed, the free end portion T1 of the sheet of paper towel T is exposed to the exterior of the container 11, as shown in FIGS. 6B, 7B, ready for being dispensed by the user by pulling the free end portion T1 and tearing along the perforations of the sheet of paper towel as described above.

As described above, during the dispensing operation the unspooling mechanism 60 prevents the roll of paper towel T from being unspooled. More specifically, in the assembled state of the towel roll and dispenser 10 shown in FIGS. 6B and 7B and with the sheet of paper towel T ready for dispensing, the portion of the sheet of paper towel T passing through the space between the bar 62 and the one side of the lip portion 30*a* of the second cover member 30 is disposed at an angle A relative to a generally planar portion 28*b* of the first cover member 28. This angular relationship A requires the sheet of paper towel T to bend or turn, such as at portion T2, prior to passing through the slot 47. By this construction, the sheet of paper towel T is prevented from inadvertently unspooling during a dispensing operation.

In the embodiment shown in FIGS. 7A-7B, the cutting edge 46*a* of the tearing lip 46 is spaced a preselected distance from the slot 47 in a depth direction of the container 11 (i.e., to the right in FIGS. 7A-7B). Thus, during a dispensing operation, the free end portion T1 of the sheet of paper towel T is pulled in a direction away from the container 11 until the perforations of the sheet are aligned with the cutting edge 46*a* of the tearing lip 46. Thereafter, the sheet of paper towel T is torn from the roll using the cutting edge 46*a*. After tearing of the sheet, the free end portion T1 of the next sheet of paper towel will be accessible for pulling and tearing in a subsequent dispensing operation by virtue of the preselected distance between the cutting edge 46*a* of the tearing lip 46 and the slot 47 as described above.

The towel roll holder and dispenser 10 according to the foregoing embodiments of the present invention further includes a securing mechanism 50 (securing means) for securing the container 11 to a support structure (not shown), such as a wall, cabinet, appliance or other surface. With reference to FIGS. 1, 3, 6A-7A and 10, the securing mechanism comprises a mounting bracket 52 integrally connected to the top 16 and the rear wall 18 of the main body 12. More specifically, the mounting bracket 52 has snap-in portions 54 for snap-fit connection with retaining slots 56 formed in the top 16 and the rear wall 18 of the main body 12. The mounting bracket 52 has mounting holes 58 formed in a portion thereof connected to the top 16 and mounting holes 59 formed in a portion thereof connected to the rear wall 18. The mounting holes 58 are suitable for mounting the towel roll holder and dispenser under a cabinet. The mounting holes 59 are suitable for mounting the towel roll holder and dispenser 10 on a vertical wall. The mounting bracket 52 may be formed of a suitable plastic or metallic material.

However, it will be appreciated that the container 11 can be mounted to a support structure in a number of other ways. For example, a plurality of magnetic strips may be secured to the top 16 of the main body 12 to allow the container 11 to be secured to a support structure made of a ferromagnetic material. Alternatively, a plurality of VELCRO strips can be secured to the top 16 of the main body 12 in lieu of the magnetic strips and affixed to complementary VELCRO strips mounted on the cabinet or other support surface. In yet another alternative embodiment, the container 11 can be mounted to the support structure by means of screws, the rear wall 18 of the housing 12 being provided with key slots, for example, for this purpose. Furthermore, when the container 11 is to be mounted is a horizontal surface of a counter top, for example, the securing mechanism is mounted at least on the bottom 14 of the main body 12.

Prior to being used, the container 11 is secured to a support structure preferably of the type and in the manner described above. In order to mount a roll of paper towel T in the container 11, the cover structure is first placed in the open position as shown in FIG. 10 by releasing the fasteners 36 and pivoting the first and second cover members 28, 30 in opposing directions away from the open front end 24 of the main body 12. The elongated rod 44 is then manually displaced along the longitudinal axis thereof at least until sufficient space is provided in the open space of the main body 12 to allow insertion of a new roll of paper towels T in the open space 26 and permit the elongated rod 44 to be passed through the roll. The elongated rod 44 is then displaced along the longitudinal axis until the end portions 44*a* thereof extend through the aligned apertures 42 of the end walls 20, 22 to carry the roll of paper towels T as described above.

Thereafter, prior to closing the first and second cover members 28, 30 of the cover structure, the end portion T1 of the severable leading sheet of paper towel T from the roll of paper towel is passed through the space between the bar 62 and the one side of the lip portion 30*a* of the second cover member 30 and through the slot 47 as described above. The cover structure is then closed with the fasteners 36 by pivoting the first and second cover members 28, 30 towards one another to place the container 11 in the ready-to-use configuration shown in FIGS. 6A, 7A. When the user of the container 11 needs to remove a sheet of the paper towel T from the roll of paper towels, he or she grasps the end portion T1 of the sheet and pulls the same from the slot 47 until the perforations on the sheet are positioned approximately adjacent to the perimeter (i.e., the longitudinal edges) of the slot 47 (i.e., in the embodiment shown in FIGS. 6A-6B) or adjacent the cutting edge 46*a* of the tearing lip 46 (i.e, in the embodiment shown in FIGS. 7A-7B). The user then tears the sheet of paper towel T1 along the perimeter of the slot 47 or along the cutting edge 46*a* to separate the sheet from the roll. When the last sheet of paper towel T1 is removed from the roll, a fresh roll is inserted in the container 11 as described above.

In the foregoing embodiments of the towel roll holder and dispenser 10 according to the present invention, the main body 12 and the cover structure (first and second cover members 28, 30) forming the container 11, including the bar 62 and support portions 64 of the unspooling mechanism 60, are preferably a one-piece structure formed from a single piece of material. For example, the single piece of material is an injection molded plastic preferably comprised of polyvinyl chloride or other similar polymeric material. The plastic material may be transparent, opaque, or translucent. A transparent material will enable a user to visually determine the amount of paper towels T left on the roll. For more decorative applications, the plastic may be colored or tinted. Alternatively, the single piece of material may be cardboard, wood, or a suitable metal, such as that formed from brushed aluminum or steel.

It is understood by those of ordinary skill in the art that it is not essential that the container be a one-piece structure formed from a single piece of material. In this regard, several alternatives are contemplated for the structure of the container 11. For example, the main body 12 may be a one-piece structure formed from a single piece of material, and the first and second cover members 28, 30 may each be formed as separate and independent components and then connected to the corresponding portions of the top 16 and bottom 14 via a suitable hinge connection so that the first and second cover members 28, are pivotable in opposing directions between the closed position (FIG. 1) and the open position (FIG. 10). Alternatively, each of the bottom 14, top 16, rear wall 18, and pair of opposing end walls 20, 22 of the main body 12 may be formed as separate and independent components and then connected together to form the main body 12 using, for example, a suitable bonding agent, such as glue, or suitable fastening members, such as an adhesive tape or brackets. When the main body 12 and the cover structure of the container 11 is formed from separate and independent components from a suitable plastic material, for example, one or more of the components of the main body 12 and/or the cover structure may be transparent to enable visual perception of the roll of paper towels T to determine the amount of paper towels T left on the roll. The bar 62 and support portions 64 of the unspooling mechanism 60 can also be formed separately and connected to the second cover member 30 using suitable connecting means.

Figure 9:
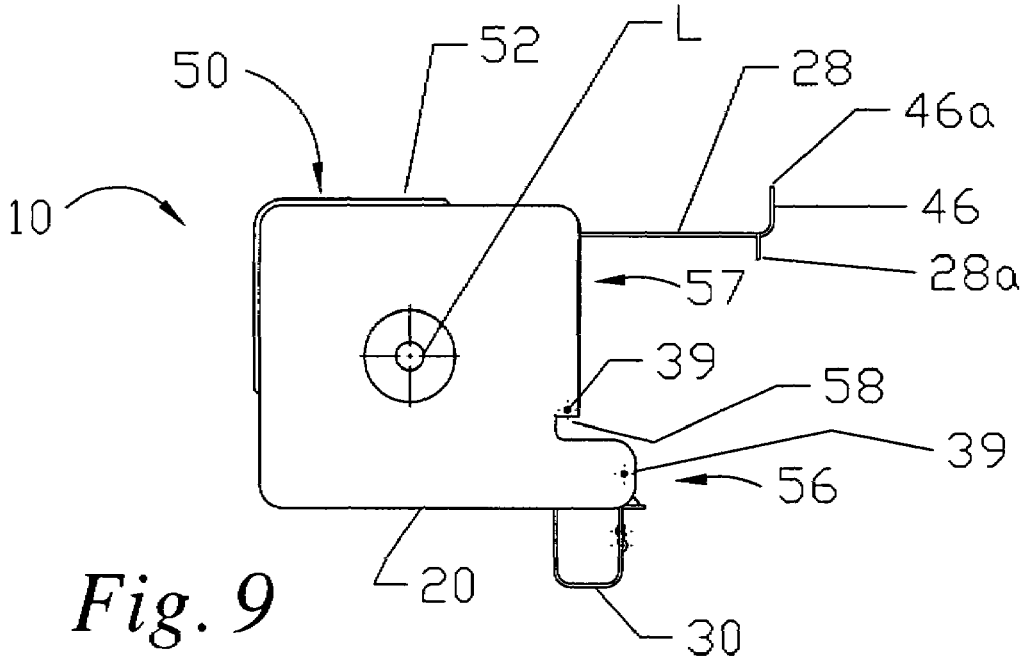
FIG. 9 is a side view of the towel roll holder and dispenser shown in FIG. 1 with the cover members in the open position.

Another feature of the towel roll holder and dispenser 10 according to the present invention is described with reference to FIGS. 1-4, 6A-6B, 7A-7B, and 8-10. As shown in these figures, the container 11 is preferably generally G-shaped in cross-section. Other than providing an aesthetic appearance to the overall structure of the container 11, the generally G-shaped cross-section of the container 11 provides a specific structural configuration which facilitates dispensing of the sheets of towels T. More specifically, as best shown in FIG. 9, the G-shaped cross-sectional shape forms portions 56, 57 of the container 11 separated by a space 58. The portion 56, which includes the second cover member 30 provided with the slot 47, protrudes or extends further from the portion 56 in a direction generally perpendicular to the longitudinal axis L of the rod 44. As is best appreciated from the perspective view of the towel roll holder and dispenser 10 shown in FIGS. 6A-6B and 7A-7B, the further extension of the portion 56 provides a clearance between the portions 56 and 57 which facilitates dispensing (i.e., pulling and tearing) of the sheet of towel T1 during a dispensing operation.

Figure 11:
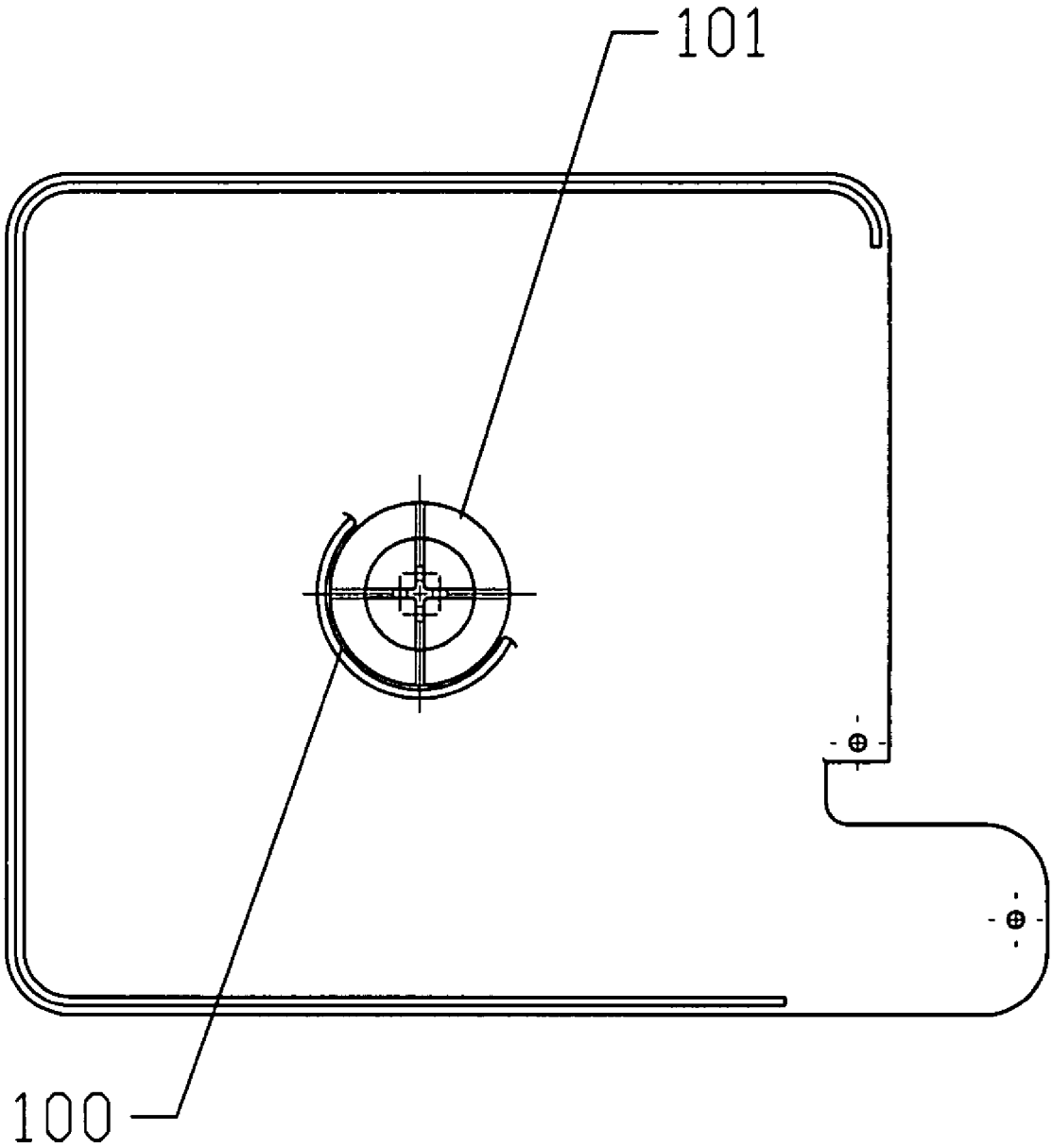
FIG. 11 is a side view of one of the end walls of the towel roll holder and dispenser showing a holding structure for the rod.

FIG. 11 is a side view of one of the end walls of the towel roll holder and dispenser showing a holding structure 100 for the elongated rod which is denoted with reference numeral 101. The holding structure 100 preferably comprises an arc-shaped portion molded in one-piece with an inner surface of the end wall. The arc-shaped portion protrudes from the inner surface of the end wall to form a resting surface for supporting one of the end portions of the elongated rod 101. Although not shown, the other end wall of the towel roll holder and dispenser is provided with an identical holding structure 100 for supporting the other end portion of the elongated rod 101.

Figure 12:
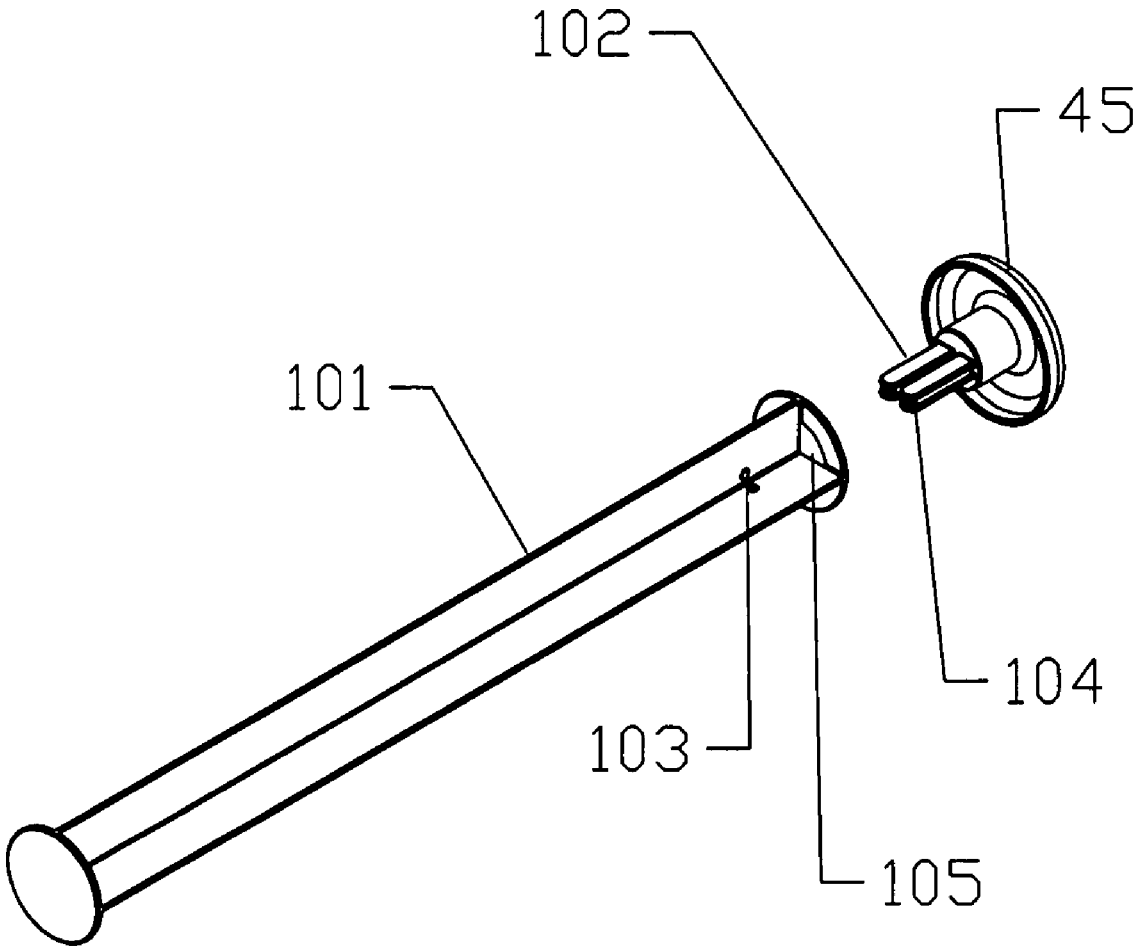
FIG. 12 is a perspective view showing a form of connection between the rod and knob of the towel roll holder and dispenser.

FIG. 12 is a perspective view showing the structure of the elongated rod 101 and the knob 45 as well as the corresponding connecting structures. In this embodiment, the elongated rod 101 has a generally plus(+)-shaped elongated portion terminating in circular plates at opposite ends thereof. The circular plate at the right end (as viewed in FIG. 12) of the elongated rod 101 is generally ring-shaped with an opening 105 for receiving therethrough portions of the knob 45 as further described below. The circular plate at the left end (as viewed in FIG. 12) of the elongated rod 101 is solid in construction (i.e., without an opening). A pair of holes 103 are formed in adjacent perpendicular walls of the elongated portion of the rod 101.

The knob 45 has a head portion and a pair side-by-side and spaced-apart protruding parts 102 extending from the head portion. Each of the protruding parts 102 has superimposed upper and lower leg portions that can be flexibly separated vertically away from each other. An inner surface of the lower leg portion of each of the protruding parts 102 has a bump portion 104 for snap-fit engagement with a corresponding hole 103 formed in the corresponding perpendicular wall of the elongated portion of the rod 101.

The knob 45 is removably attached to the elongated rod 101 by passing the protruding portions 102 through the opening 105 of the ring-shaped circular plate and passing one of the walls of the elongated portion of the rod 101 between the protruding parts 102 until the bumps 104 of the leg portions of the protruding parts 102 engage the respective hole 103 formed in the corresponding adjacent perpendicular walls of the elongated portion of the rod 101. The knob 45 can be removed by flexing the leg portions of each protruding part 102 in opposite directions until the bumps 104 disengage the holes 103 and then moving the knob 45 away from the elongated rod 101.

In this embodiment, the elongated rod 101 is constructed for detachable connection of the knob 45 to only the right end (as viewed in FIG. 12) of the elongated rod 101. It will be appreciated, however, that the left end (as viewed in FIG. 12) of the elongated rod 101 can also, or instead of, be arranged with a circular plate and the elongated portion provided with the holes 103, as described above for the left end, in order accommodate the detachable connection of a knob 45.

Thus it will be appreciated from the foregoing description that the present invention provides a towel roll holder and dispenser having a container for retaining a roll of toweling made, for example, of paper, cloth, fabric, or the like, so that the individual towels of the roll can be easily dispensed therefrom, and so that a new roll can be quickly and easily inserted into the container when the old one is exhausted. The towel roll holder and dispenser prevents towels from the roll from becoming dirty by keeping the towels in a clean and sanitary condition prior to being dispensed from the towel roll holder and dispenser.

Moreover, the towel roll holder and dispenser of the present invention is easily affixed to a support structure, such as a wall, cabinet, appliance or other surface, and is easily opened for replacement of the roll. The towel roll holder and dispenser of the present invention is simple and easy to use, is easy and economical to manufacture, may be manufactured in any size and weight, and is highly durable and resistant to structural or performance degradation.

From the foregoing description, it can be seen that the present invention comprises an improved towel roll holder and dispenser. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

We claim:

1. A towel roll holder and dispenser adapted for mounting on a support surface, the towel roll holder and dispenser comprising:

a housing for receiving a towel roll therewithin, the housing having a pair of sidewalls, a base connected to the sidewalls for mounting the housing on the support surface, and a pair of cover members pivotable between a closed position and an open position, one of the cover members having an opening through which towels may be dispensed from the towel roll during a dispensing operation;

a plurality of fasteners that releasably fasten the cover members to the sidewalls of the housing;

a retaining mechanism that rotatively retains the roll of towels within the housing between the pair of sidewalls so that a free portion of a towel from the roll of towels can extend through the opening during a dispensing operation;

an unspooling mechanism that prevents towels from inadvertently unspooling from the roll of paper towels during a dispensing operation;

a tearing mechanism that tears off the free portion of the towel from the roll of towels during a dispensing operation; and a securing mechanism that secures the housing to a support structure.

2. A towel roll holder and dispenser according to claim 1; wherein the housing is a one-piece structure made from a single piece of material.

3. A towel roll holder and dispenser according to claim 2; wherein the single piece of material is injection molded plastic.

4. A towel roll holder and dispenser according to claim 1; wherein the opening of the one of the cover members of the housing comprises a contoured elongated aperture.

5. A towel roll holder and dispenser according to claim 4; wherein the tearing mechanism comprises a longitudinal portion of the one of the cover members overlapping the elongated aperture, the longitudinal portion having a cutting edge.

6. A towel roll holder and dispenser according to claim 1; wherein the retaining mechanism comprises the sidewalls of the housing having aligned apertures therethrough, an elongated rod having opposite end portions extendable through the respective aligned apertures of the sidewalls, and at least one knob configured and dimensioned to receive an end portion of the elongated rod.

7. A towel roll holder and dispenser according to claim 1; wherein the fasteners comprise a plurality of holes formed in the sidewalls of the housing and a plurality of snap locks for releasable engagement with the respective holes.

8. A towel roll holder and dispenser according to claim 1; wherein the housing is formed of a transparent material that enables visual perception of the roll of towels when enclosed by the housing.

9. A towel roll holder and dispenser according to claim 1; wherein the securing mechanism secures at least one of the base, a top wall, and a rear wall of the housing to a support structure.

10. A towel roll holder and dispenser according to claim 9; wherein the securing mechanism comprises a mounting bracket for removable connection to the at least one of the base, top wall and rear wall of the housing.

11. A towel roll holder and dispenser according to claim 9; wherein each of the top and the rear wall of the housing has a plurality of holes; and wherein the mounting bracket has a plurality of connecting portions for removable integral connection to the respective holes of the top and the rear wall of the housing.

12. A towel roll holder and dispenser according to claim 1; wherein in the closed position of the cover members, the housing has a generally G-shaped cross-section.

13. A towel roll holder and dispenser according to claim 1; wherein the unspooling mechanism comprises a longitudinal bar integrally connected to a surface of one of the cover members by support portions to define a longitudinal space between the bar and the one of the cover members through which a towel from the roll of towels passes when the one of the cover members is in the closed position and prior to being dispensed from the housing.

14. A towel roll holder and dispenser according to claim 13; wherein the bar and the support portions form a one-piece structure with the one of the cover member made from a single piece of material.

* * * * *